US011963614B2

(12) United States Patent
Wiedeman et al.

(10) Patent No.: US 11,963,614 B2
(45) **Date of Patent: *Apr. 23, 2024**

(54) COLLAPSIBLE STANDING DESK

(71) Applicants: Derrek Wiedeman, Wilmington, DE (US); Brandon Middleton, Davidsonville, MD (US)

(72) Inventors: Derrek Wiedeman, Wilmington, DE (US); Brandon Middleton, Davidsonville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/888,358

(22) Filed: Aug. 15, 2022

(65) Prior Publication Data

US 2024/0049876 A1 Feb. 15, 2024

(51) Int. Cl.
*A47B 9/20* (2006.01)
*A47B 13/08* (2006.01)

(52) U.S. Cl.
CPC ..... *A47B 9/20* (2013.01); *A47B 13/081* (2013.01)

(58) Field of Classification Search
CPC ..... A47B 9/20; A47B 13/081
USPC ..... 108/95, 49, 65, 67, 69, 77, 88; 248/188.7, 188.5, 161, 132, 157
See application file for complete search history.

(56) References Cited

U.S. PATENT DOCUMENTS 554,661 A * 2/1896 Doolittle ..... A47G 7/041 403/186
1,466,191 A * 8/1923 Roos ..... A47F 5/06 108/95
2,586,724 A * 2/1952 Sannebeck ..... A47C 3/34 108/138
3,145,966 A * 8/1964 Landon ..... A47B 97/08 108/115
3,212,748 A * 10/1965 Faurot ..... A47B 23/04 248/458
5,746,334 A * 5/1998 Brandenberg ..... A47B 9/14 211/205

(Continued)

OTHER PUBLICATIONS

Alexey Ukhnalev, Tripodsy, https://www.indiegogo.com/projects/-274996?fbclid=IwAR0tbP1yv0POQ6XVTO8Bq131X126rqKZJ4uzECg0M5FrhclodDTpf2m0Nec#/.

(Continued)

*Primary Examiner* — Jose V Chen
(74) *Attorney, Agent, or Firm* — The Iwashko Law Firm, PLLC; Lev Ivan Gabriel Iwashko

(57) ABSTRACT

A collapsible standing desk, including a first platform to receive at least one first item thereon, the first platform including a first section, and a second section movably disposed on at least a portion of the first section to move toward the first section in a first rotational direction, and away from the first section in a second rotational direction opposite with respect to the first rotational direction, a second platform connected to the first platform to receive at least one second item thereon, the second platform including another first section, and another second section movably disposed on at least a portion of the another first section to move toward the another first section in the first rotational direction, and away from the another first section in the second rotational direction opposite with respect to the first rotational direction, and a base connected to the first platform and the second platform to support the first platform and the second platform thereon while disposed on an external surface.

6 Claims, 1 Drawing Sheet

(56) References Cited

U.S. PATENT DOCUMENTS

| | | | | |
|---|---|---|---|---|
| 6,298,794 | B1 * | 10/2001 | Brown | A47B 21/00 108/50.01 |
| 6,748,873 | B2 * | 6/2004 | Brown, Sr. | A47B 23/041 248/161 |
| 7,240,886 | B2 * | 7/2007 | Jones | F16M 11/08 248/161 |
| 8,191,487 | B2 * | 6/2012 | Theesfeld | F16M 11/24 108/50.01 |
| 10,323,785 | B1 * | 6/2019 | Takahashi | F16M 11/12 |
| 2002/0170470 | A1 * | 11/2002 | Cheng | B60N 3/002 108/69 |
| 2004/0211343 | A1 * | 10/2004 | Song | A47B 21/03 108/50.01 |
| 2016/0008070 | A1 * | 1/2016 | Choudhury | A47B 9/20 108/106 |

OTHER PUBLICATIONS

Tripodsy Store, Tripodsy, https://www.amazon.com/dp/B09PBK55DJ?m=AWHP0VORHBDUT&ref=mpc_asin_title, Dec. 28, 2021.
Tripodsy, Tripodsy, https://tripodsy.com/products/tripodsy-portable-standing-adjustable-workstation.
Tripodsy, https://www.facebook.com/tripodsy, Jan. 4, 2022.

* cited by examiner

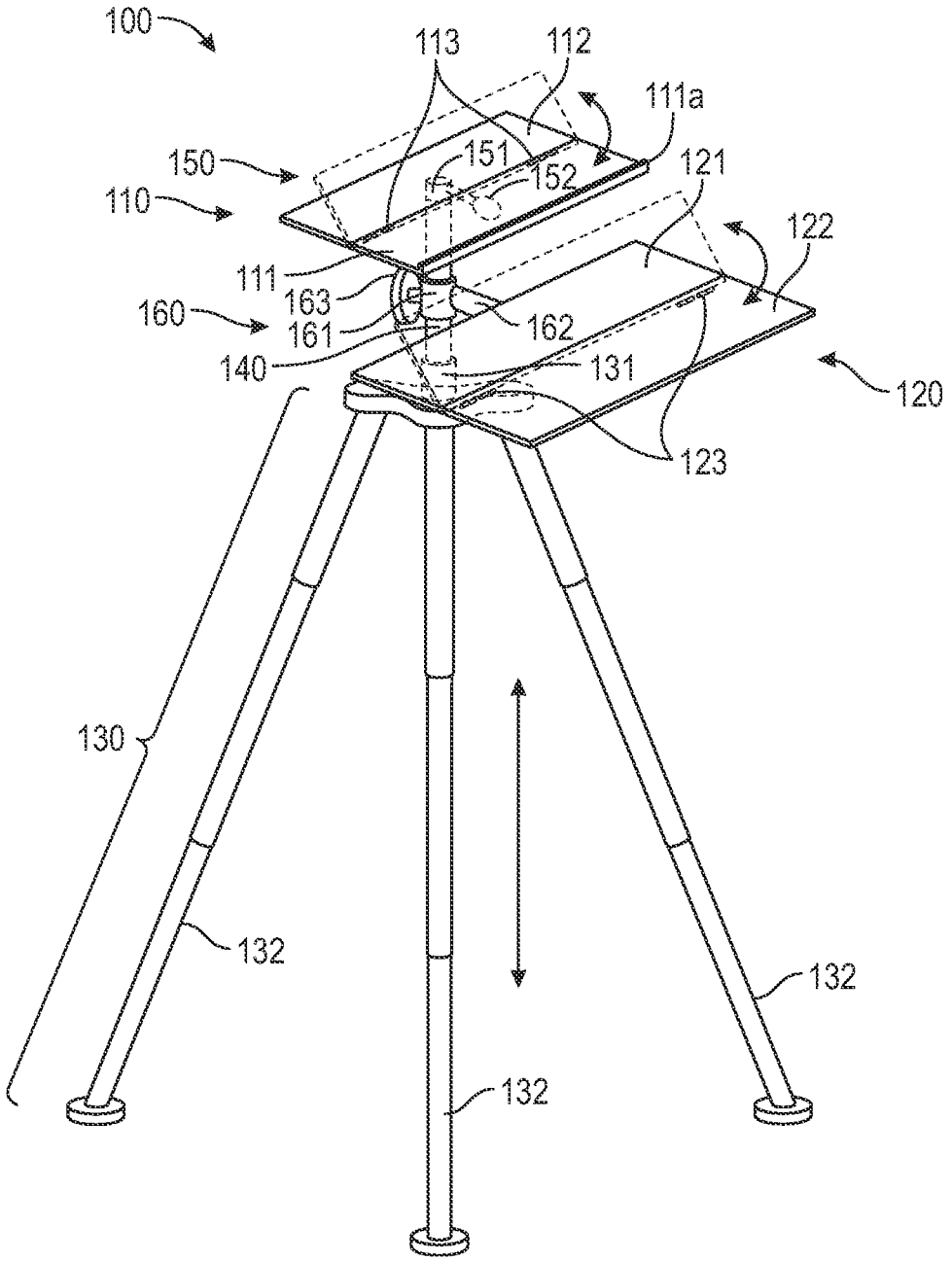
100
113
112
111a
150
151
152
121
110
122
111
163
160
161
162
140
131
120
123
130
132
132
132

COLLAPSIBLE STANDING DESK

BACKGROUND

1. Field

The present general inventive concept relates generally to a desk, and particularly, to a collapsible standing desk.

2. Description of the Related Art

For many people who travel, the only usable workspace is usually a sitting desk at a hotel, office, and/or coworking space. Most of the aforementioned facilities, rarely offer a standing desk, as an alternative workspace. However, the standing desk is often preferable to the sitting desk since it provides a workspace while the person is standing, which is better for a back of a person.

Also, the standing desk often takes up more space, which causes difficulty to store the standing desk at home on a permanent basis.

Therefore, there is a need for a collapsible standing desk that is portable for travel and can be easily stored after being collapsed.

SUMMARY

The present general inventive concept provides a collapsible standing desk.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a collapsible standing desk, including a first platform to receive at least one first item thereon, the first platform including a first section, and a second section movably disposed on at least a portion of the first section to move toward the first section in a first rotational direction, and away from the first section in a second rotational direction opposite with respect to the first rotational direction, a second platform connected to the first platform to receive at least one second item thereon, the second platform including another first section, and another second section movably disposed on at least a portion of the another first section to move toward the another first section in the first rotational direction, and away from the another first section in the second rotational direction opposite with respect to the first rotational direction, and a base connected to the first platform and the second platform to support the first platform and the second platform thereon while disposed on an external surface.

The first platform may be disposed on a first plane and the second platform is disposed on a second plane different from the first plane.

The base may include a base connector, and a plurality of telescopic legs movably disposed on at least a portion of the base connector to move from retracted against the base connector in a first position to at least partially extended away from the base connector in a second position, and move from extended away from the base connector in the second position to retracted against the base connector in the first position.

The collapsible standing desk may further include a center pole disposed on at least a portion of the base to connect the first platform and the second platform to the base.

The collapsible standing desk may further include a platform adjuster movably disposed on at least a portion of the center pole and connected to the first platform to move the first platform clockwise in response to an application of force in a first direction, and move the first platform counterclockwise in response to the application of force in a second direction opposite with respect to the first direction.

The collapsible standing desk may further include a height collar movably disposed on at least a portion of the center pole to facilitate movement of the height collar along at least a portion of a length of the center pole in a first setting, and prevent movement of the height collar on the center pole in a second setting.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a top isometric view of a collapsible standing desk, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Collapsible Standing Desk 100
First Platform 110
First Section 111
Second Section 112
Hinges 113
Second Platform 120
First Section 121
Second Section 122
Hinges 123
Base 130
Base Connector 131
Telescopic Legs 132
Center Pole 140
Platform Adjuster 150
Platform Connector 151
Handle 152
Height Collar 160
Collar Body 161
Protruding Rod 162
Adjustment Knob 163

FIG. 1 illustrates a top isometric view of a collapsible standing desk 100, according to an exemplary embodiment of the present general inventive concept.

The collapsible standing desk 100 may be constructed from at least one of metal, plastic, wood, and rubber, etc., but is not limited thereto.

The collapsible standing desk 100 may include a first platform 110, a second platform 120, a base 130, a center pole 140, a platform adjuster 150, and a height collar 160, but is not limited thereto.

Referring to FIG. 1, the first platform 110 is illustrated to have a rectangular prism shape. However, the first platform 110 may be rectangular, circular, cylindrical, triangular, pentagonal, hexagonal, heptagonal, octagonal, or any other shape known to one of ordinary skill in the art, but is not limited thereto.

The first platform 110 may include a first section 111, a second section 112, and a plurality of hinges 113, but is not limited thereto.

The first section 111 may include an elevated edge 111*a*, but is not limited thereto.

The first section 111 may be a planar surface. Moreover, the first section 111 may receive at least one first item thereon. Also, the elevated edge 111*a* may be disposed on at least a portion of an edge of the first section 111. The elevated edge 111*a* may be elevated with respect to a surface of the first section 111.

The second section 112 may be a planar surface. The second section 112 may be disposed on at least a portion of the first section 111. Additionally, the second section 112 may move (i.e. pivot, rotate) toward the first section 111 in a first rotational direction. Conversely, the second section 112 may move away from the first section 111 in a second rotational direction opposite with respect to the first rotational direction. Furthermore, the second section 112 may receive the at least one first item thereon. As such, the second section 112 may fold and/or collapse against the first section 111 for storage.

Collectively, the first section 111 and/or the second section 112 may receive the at least one first item, such as a laptop computer, a desktop computer, a tablet computer, a notebook, a monitor, a display unit (e.g., a screen), and/or a notepad. As such, the first section 111 and/or the second section 112 may have a size (e.g., length, width, dimension) corresponding to a size of the at least one first item. Also, the elevated edge 111*a* may prevent the at least one first item from moving off the first section 111 and/or the second section 112 in a lateral direction toward the elevated edge 111*a*.

The plurality of hinges 113 may be disposed between at least a portion of the first section 111 and/or the second section 112. Each of the plurality of hinges 113 may facilitate movement (i.e., pivot, rotate) of the second section 112 with respect to the first section 111.

The second platform 120 may include a first section 121, a second section 122, and a plurality of hinges 123, but is not limited thereto.

The first section 121 may be a planar surface. Moreover, the first section 121 may receive at least one second item thereon.

The second section 122 may be a planar surface. The second section 122 may be disposed on at least a portion of the first section 121. Additionally, the second section 122 may move (i.e. pivot, rotate) toward the first section 121 in the first rotational direction. Conversely, the second section 122 may move away from the first section 121 in the second rotational direction opposite with respect to the first rotational direction. Furthermore, the second section 122 may receive the at least one second item thereon. As such, the second section 122 may fold and/or collapse against the first section 121 for storage.

Collectively, the first section 121 and/or the second section 122 may receive the at least one second item, such as a computer mouse, a keyboard, a stylus, and/or a set of headphones. As such, the first section 121 and/or the second section 122 may have a size (e.g., length, width, dimension) corresponding to a size of the at least one second item and/or a plurality of items. The second platform 120 may be larger than the first platform 110.

The plurality of hinges 123 may be disposed between at least a portion of the first section 121 and/or the second section 122. Each of the plurality of hinges 123 may facilitate movement (i.e., pivot, rotate) of the second section 122 with respect to the first section 121.

The base 130 may include a base connector 131 and a plurality of telescopic legs 132, but is not limited thereto.

The base connector 131 may be connected to the first platform 110 and/or the second platform 120. The plurality of telescopic legs 132 may be movably (i.e., telescopically) disposed on at least a portion of the base connector 131. In other words, the plurality of telescopic legs 132 may move from retracted against the base connector 131 in a first position to at least partially extended away from the base connector 131 in a second position. Conversely, the plurality of telescopic legs 132 may move from extended away from the base connector 131 in the second position to retracted against the base connector 131 in the first position. The plurality of telescopic legs 132 may support the first platform 110 and/or the second platform 120 thereon while disposed on an external surface (e.g., a ground surface, a table, a desk).

Accordingly, the plurality of telescopic legs 132 may be retracted for storage and extended during use, such as a on a trip to a hotel and/or an office.

The center pole 140 may be elongate shaped and/or disposed on at least a portion of a center of the base connector 131. The center pole 140 may be connected to the first platform 110 and/or the second platform 120, and connect the first platform 110 and/or the second platform 120 to the base 130. It is important to note that the center portion of the base connector 131 may maximize stability of the first platform 110 and/or the second platform 120.

Also, the center pole 140 may be telescopic, such that the center pole 140 may retract and/or extend similar to the plurality of telescopic legs 132.

The platform adjuster 150 may include a platform connector 151 and a handle 152, but is not limited thereto.

The platform connector 151 may be movably (i.e., rotatably) disposed on at least a portion of the center pole 140 and/or connected to the first platform 110 (e.g., the first section 111).

The handle 152 may be disposed on at least a portion of the platform connector 151. The handle 152 may facilitate gripping thereof. Moreover, the platform connector 151 may move clockwise in response to an application of force (e.g., pushing, pulling) to the handle 152 in a first direction. Alternatively, the platform connector 151 may move counterclockwise in response to the application of force to the handle 152 in a second direction opposite with respect to the first direction. As such, the handle 152 may adjust a position of the at least one first item disposed on the first platform 110.

The height collar 160 may include a collar body 161, a protruding rod 162, and an adjustment knob 163, but is not limited thereto.

The collar body 161 may be movably (i.e., slidably) disposed on at least a portion of the center pole 140. The collar body 161 may be cylindrical to receive the center pole 140 therethrough.

The protruding rod 162 may be disposed at a first end on at least a portion of the collar body 161. Additionally, the protruding rod 162 may extend a distance away from the collar body 161. The protruding rod 162 may be connected at a second end to the second platform 120. As such, the second platform 120 may be disposed away from the center pole 140 equivalent to a length of the protruding rod 162.

Furthermore, the first platform 110 may be disposed on at a first plane and the second platform 120 may be disposed at a second plane different from the first plane.

The adjustment knob 163 may be movably (i.e., rotatably) disposed on at least a portion of the collar body 161. The adjustment knob 163 may facilitate movement of the collar body 161 along at least a portion of a length of the center pole 140. More specifically, the adjustment knob 163 may facilitate movement (e.g., unlocked) of the collar body 161 in response to moving in a first direction (i.e., clockwise) or a second direction (i.e., counterclockwise) in a first setting, such that the collar body 161 and/or the second platform 120 may be adjusted to a different position (e.g., height) on the center pole 140. Conversely, the adjustment knob 163 may prevent movement of the collar body 161 in response to moving in the second direction or the first direction in a second setting, such that the collar body 161 and/or the second platform 120 may be fixed (i.e., locked) in place.

Therefore, the collapsible standing desk 100 may be a portable standing desk that can be brought during travel to provide an alternative to a sitting desk. Also, the collapsible standing desk 100 can be easily and/or ergonomically stored after being collapsed, such as in a carrying container.

The present general inventive concept may include a collapsible standing desk 100, including a first platform 110 to receive at least one first item thereon, the first platform 110 including a first section 111, and a second section 112 movably disposed on at least a portion of the first section 111 to move toward the first section 111 in a first rotational direction, and away from the first section 111 in a second rotational direction opposite with respect to the first rotational direction, a second platform 112 connected to the first platform 110 to receive at least one second item thereon, the second platform 120 including another first section 121, and another second section 122 movably disposed on at least a portion of the another first section 121 to move toward the another first section 121 in the first rotational direction, and away from the another first section 121 in the second rotational direction opposite with respect to the first rotational direction, and a base 130 connected to the first platform 110 and the second platform 120 to support the first platform 110 and the second platform 120 thereon while disposed on an external surface.

The first platform 110 may be disposed on a first plane and the second platform 120 is disposed on a second plane different from the first plane.

The base 130 may include a base connector 131, and a plurality of telescopic legs 132 movably disposed on at least a portion of the base connector 131 to move from retracted against the base connector 131 in a first position to at least partially extended away from the base connector 131 in a second position, and move from extended away from the base connector 131 in the second position to retracted against the base connector 131 in the first position.

The collapsible standing desk 100 may further include a center pole 140 disposed on at least a portion of the base 130 to connect the first platform 110 and the second platform 120 to the base 110.

The collapsible standing desk 100 may further include a platform adjuster 150 movably disposed on at least a portion of the center pole 140 and connected to the first platform 110 to move the first platform 110 clockwise in response to an application of force in a first direction, and move the first platform 110 counterclockwise in response to the application of force in a second direction opposite with respect to the first direction.

The collapsible standing desk 100 may further include a height collar 160 movably disposed on at least a portion of the center pole 140 to facilitate movement of the height collar 160 along at least a portion of a length of the center pole 140 in a first setting, and prevent movement of the height collar 160 on the center pole 140 in a second setting.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A collapsible standing desk, comprising:

a first platform to receive at least one first item thereon, the first platform comprising: a first section, and a second section movably disposed on at least a portion of the first section to move toward the first section in a first rotational direction, and away from the first section in a second rotational direction opposite with respect to the first rotational direction;

a second platform connected to the first platform to receive at least one second item thereon, the second platform comprising:

another first section, and another second section movably disposed on at least a portion of the another first section to move toward the another first section in the first rotational direction, and away from the another first section in the second rotational direction opposite with respect to the first rotational direction;

a base connected to the first platform and the second platform to support the first platform and the second platform thereon while disposed on an external surface, such that the first platform is disposed at and above a topmost portion of the base; and a center pole disposed on at least a portion of the base to connect the first platform and the second platform to the base, such that the first platform is disposed at and above a topmost surface of a top most portion of the center pole.

2. The collapsible standing desk of claim 1, wherein the first platform is disposed on a first plane and the second platform is disposed on a second plane different from the firstplane.

3. The collapsible standing desk of claim 1, wherein the base comprises: a base connector; and a plurality of telescopic legs movably disposed on at least a portion of the base connector to move from retracted against the base connector in a first position to at least partially extended away from the base connector in a second position, and move from extended away from the base connector in the second position to retracted against the base connector in the first position.

4. The collapsible standing desk of claim 1, further comprising:

a platform adjuster movably disposed on at least a portion of the center pole and connected to the first platform to move the first platform clockwise in response to an application of force in a clockwise direction, and move the first platform counterclockwise in response to the application of force in a counterclockwise direction opposite with respect to the clockwise direction.

5. The collapsible standing desk of claim 1 further comprising:

a height collar movably disposed on at least a portion of the center pole to facilitate movement of the height collar along at least a portion of a length of the center pole in a first setting, and prevent movement of the height collar on the center pole in a second setting.

6. A collapsible standing desk, comprising:

a first platform to receive at least one first item thereon, the first platform comprising:

a first section,and a second section movably disposed on at least a portion of the first section to move toward the first section in a first rotational direction, and away from the first section in a second rotational direction opposite with respect to the first rotational direction;

a second platform connected to the first platform to receive at least one second item thereon, the second platform comprising:

another first section, and another second section movably disposed on at least a portion of the another first section to move toward the another first section in the first rotational direction, and away from the another first section in the second rotational direction opposite with respect to the first rotational direction;

a base connected to the first platform and the second platform to support the first platform and the second platform thereon while disposed on an external surface, such that the first platform is disposed at and above a topmost portion of the base;

a center pole disposed on at least a portion of the base to connect the first platform and the second platform to the base; and a platform adjuster movably disposed on at least a portion of the center pole and connected to the first platform to move the first platform clockwise in response to an application of force in a clockwise direction, and move the first platform counterclockwise in response to the application of force in a counterclockwise direction opposite with respect to the clockwise direction.

* * * * *